US010820685B1

(12) United States Patent
Becker

(10) Patent No.: US 10,820,685 B1
(45) Date of Patent: Nov. 3, 2020

(54) COMPACT CLEANING SYSTEM

(71) Applicant: Harold R. Becker, Clerawater, FL (US)

(72) Inventor: Harold R. Becker, Clerawater, FL (US)

( * ) Notice: Subject to any disclaimer, the term of this patent is extended or adjusted under 35 U.S.C. 154(b) by 0 days.

(21) Appl. No.: 16/297,598

(22) Filed: Mar. 9, 2019

Related U.S. Application Data

(63) Continuation-in-part of application No. 15/291,337, filed on Oct. 12, 2016.

(60) Provisional application No. 62/241,589, filed on Oct. 14, 2015.

(51) Int. Cl.

| | |
|---|---|
| ***B08B 1/00*** | (2006.01) |
| ***A46B 13/02*** | (2006.01) |
| ***A46B 5/00*** | (2006.01) |
| ***B08B 1/04*** | (2006.01) |
| *B08B 13/00* | (2006.01) |

(52) U.S. Cl.
CPC ..... *A46B 13/02* (2013.01); *A46B 5/0095* (2013.01); *B08B 1/002* (2013.01); *B08B 1/04* (2013.01); *A46B 2200/30* (2013.01); *B08B 13/00* (2013.01)

(58) Field of Classification Search
CPC ..... B08B 1/002; B08B 1/04; B08B 13/00; A46B 5/0095; A46B 2200/30; A46B 13/02
See application file for complete search history.

(56) References Cited

U.S. PATENT DOCUMENTS

| | | | | |
|---|---|---|---|---|
| 2,545,659 | A * | 3/1951 | Ginter | B23B 45/001 16/426 |
| 4,796,321 | A * | 1/1989 | Lee | A46B 13/04 15/29 |
| 2004/0074025 | A1* | 4/2004 | Blaustein | B25F 3/00 15/23 |
| 2004/0148918 | A1* | 8/2004 | Smith | A01D 34/416 56/12.7 |
| 2004/0261204 | A1* | 12/2004 | Pears | A47L 11/38 15/28 |
| 2006/0236474 | A1* | 10/2006 | Jaffe | A46B 5/0008 15/28 |
| 2011/0113574 | A1* | 5/2011 | Fulmer | A46B 9/02 15/21.1 |
| 2015/0320286 | A1* | 11/2015 | Tronson, Sr. | A47L 11/4041 15/52.1 |
| 2018/0146773 | A1* | 5/2018 | Kress | A01M 21/02 |

FOREIGN PATENT DOCUMENTS

| | | | | |
|---|---|---|---|---|
| WO | WO-2016008763 | A2 * | 1/2016 | A01M 21/02 |

* cited by examiner

*Primary Examiner* — Sharidan Carrillo

(57) ABSTRACT

A housing has a rearward end with a handle. The housing has a forward end with a motor housing and a laterally spaced guard housing. The housing has a housing axis extending between the forward end and the rearward end. The guard housing is located to the left side of the forward end. A motor located within the motor housing has a drive shaft rotatable around a horizontal axis of rotation perpendicular with the housing axis and extending into the guard housing. A brush wheel mounted on the drive shaft rotates with the drive shaft for brushing and cleaning small bathroom grout, tub and shower walls and floors, kitchen and bathroom sinks, especially under-mounted, around windows and more.

1 Claim, 4 Drawing Sheets

COMPACT CLEANING SYSTEM

RELATED APPLICATION

The present invention is a continuation-in-part of pending U.S. patent application Ser. No. 15/291,337 filed Oct. 12, 2016, which is based upon Provisional Application No. 62/241,589 filed Oct. 14, 2015, the subject matter of which applications is incorporated herein by reference.

BACKGROUND OF THE INVENTION

Field of the Invention

The present invention relates to a compact cleaning system and more particularly pertains to brushing and cleaning small bathroom grout, tub and shower walls and floors, kitchen and bathroom sinks, especially under-mounted, around windows and more. The brushing and cleaning are done in a safe, convenient, and economical manner.

Description of the Prior Art

The use of compact cleaning systems of known designs and configurations is known in the prior art. More specifically, compact cleaning systems of known designs and configurations previously devised and utilized for the purpose of brushing and cleaning are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the aforementioned devices do not describe a compact cleaning system that allows for brushing and cleaning small bathroom grout, tub and shower walls and floors, kitchen and bathroom sinks, especially under-mounted, around windows and more.

In this respect, the compact cleaning system according to the present invention substantially departs from the conventional concepts and designs of the prior art, and in doing so provides an apparatus primarily developed for the purpose of brushing and cleaning small bathroom grout, tub and shower walls and floors, kitchen and bathroom sinks, especially under-mounted, around windows and more. The brushing and cleaning are done in a safe, convenient, and economical manner.

Therefore, it can be appreciated that there exists a continuing need for a new and improved compact cleaning system which can be used for brushing and cleaning small bathroom grout, tub and shower walls and floors, kitchen and bathroom sinks, especially under-mounted, around windows and more. The brushing and cleaning are done in a safe, convenient, and economical manner. In this regard, the present invention substantially fulfills this need.

SUMMARY OF THE INVENTION

In view of the disadvantages inherent in the known types of compact cleaning systems of known designs and configurations now present in the prior art, the present invention provides an improved compact cleaning system. As such, the general purpose of the present invention, which will be described subsequently in greater detail, is to provide a new and improved compact cleaning system and method which has all the advantages of the prior art and none of the disadvantages.

From a broad context, first provided is a hollow housing. The housing has a left side and a right side. The housing has a rearward end with a handle and a forward end with a motor housing. A housing axis extends between the forward end and the rearward end. A guard housing is laterally spaced to the left side of the forward end. A motor is located within the motor housing. The motor has a drive shaft rotatable around a horizontal axis of rotation perpendicular to the housing axis. The drive shaft is adapted to extend into the guard housing. A brush wheel is mounted on the drive shaft for concurrent rotation. Such components are individually configured and correlated with respect to each other so as to attain the desired objective.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved compact cleaning system which has all of the advantages of the prior art tile and paver grout cleaning systems of known designs and configurations and none of the disadvantages.

It is another object of the present invention to provide a new and improved compact cleaning system which may be easily and efficiently manufactured and marketed.

It is a further object of the present invention to provide a new and improved compact cleaning system which is of durable and reliable constructions.

An even further object of the present invention is to provide a new and improved compact cleaning system which is susceptible of a low cost of manufacture with regard to both materials and labor, and which accordingly is then susceptible of low prices of sale to the consuming public, thereby making such compact cleaning system economically available to the buying public.

Lastly, it is an object of the present invention to provide a new and improved compact cleaning system for brushing and cleaning small bathroom grout, tub and shower walls and floors, kitchen and bathroom sinks, especially under-mounted, around windows and more.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
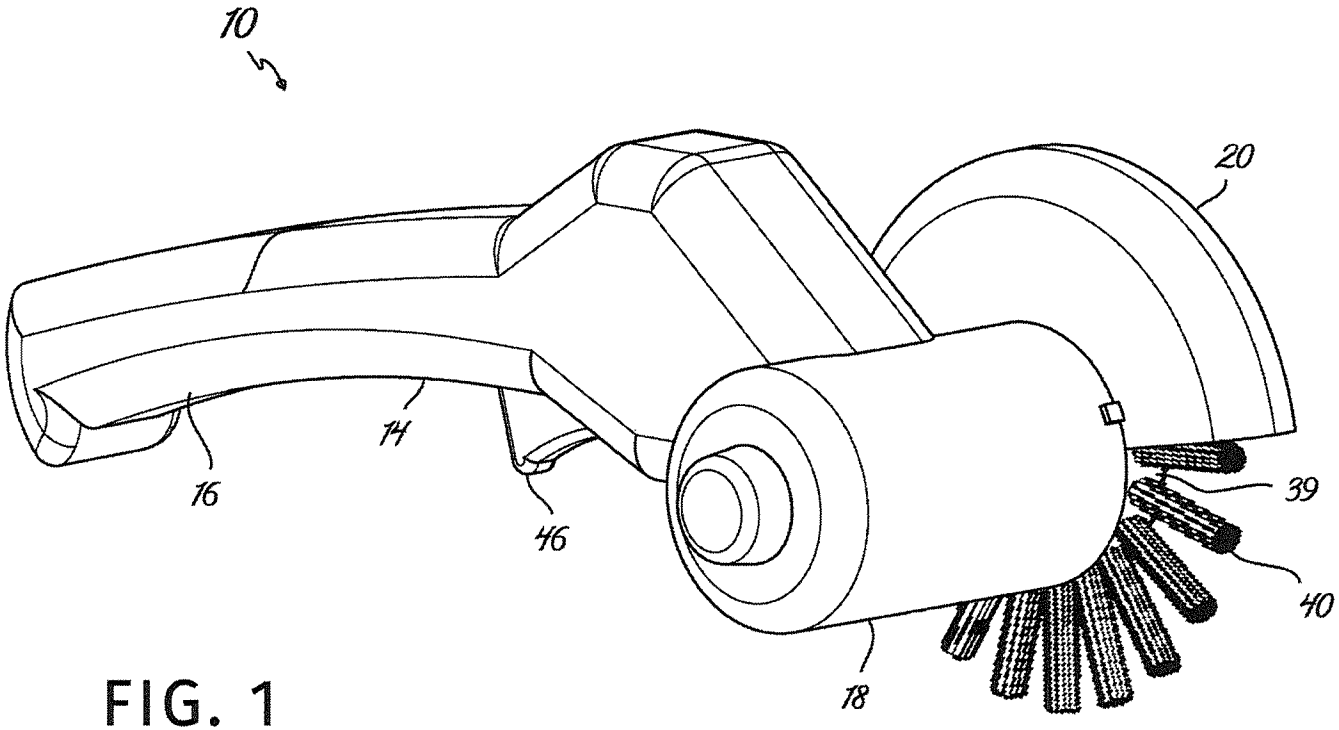
FIG. 1 is a right side perspective illustration of a compact grout cleaning system constructed in accordance with the principles of the present invention.
Figure 2:
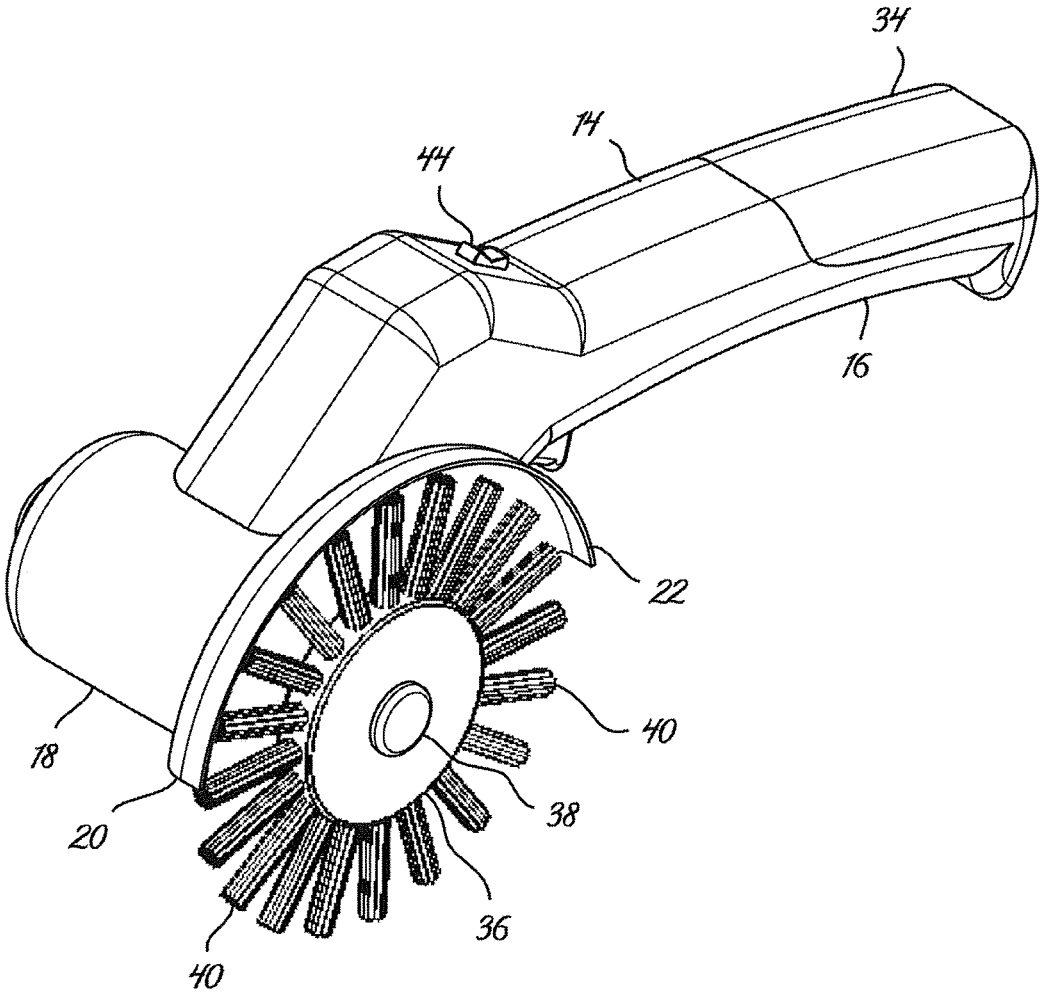
FIG. 2 is a left side perspective illustration of the system of FIG. 1.
Figure 3A:
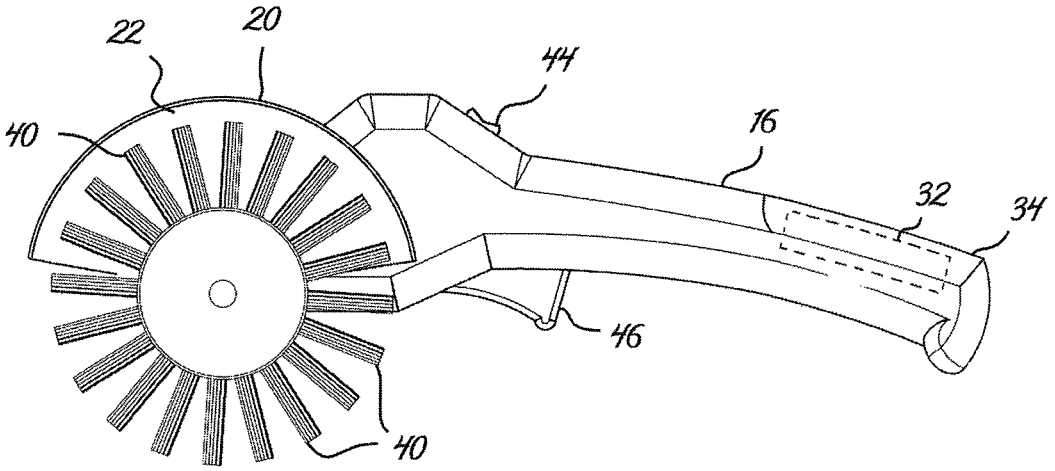
FIG. 3A is a side elevational view of the system of FIGS. 1 and 2.
Figure 3B:
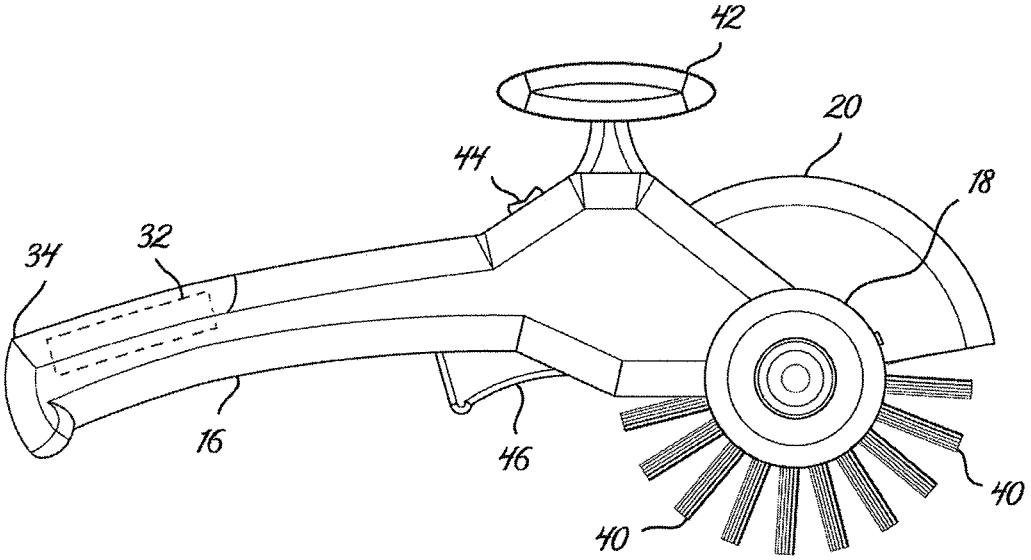
FIG. 3B is another side elevational view of the system including a secondary handle.
Figure 4:
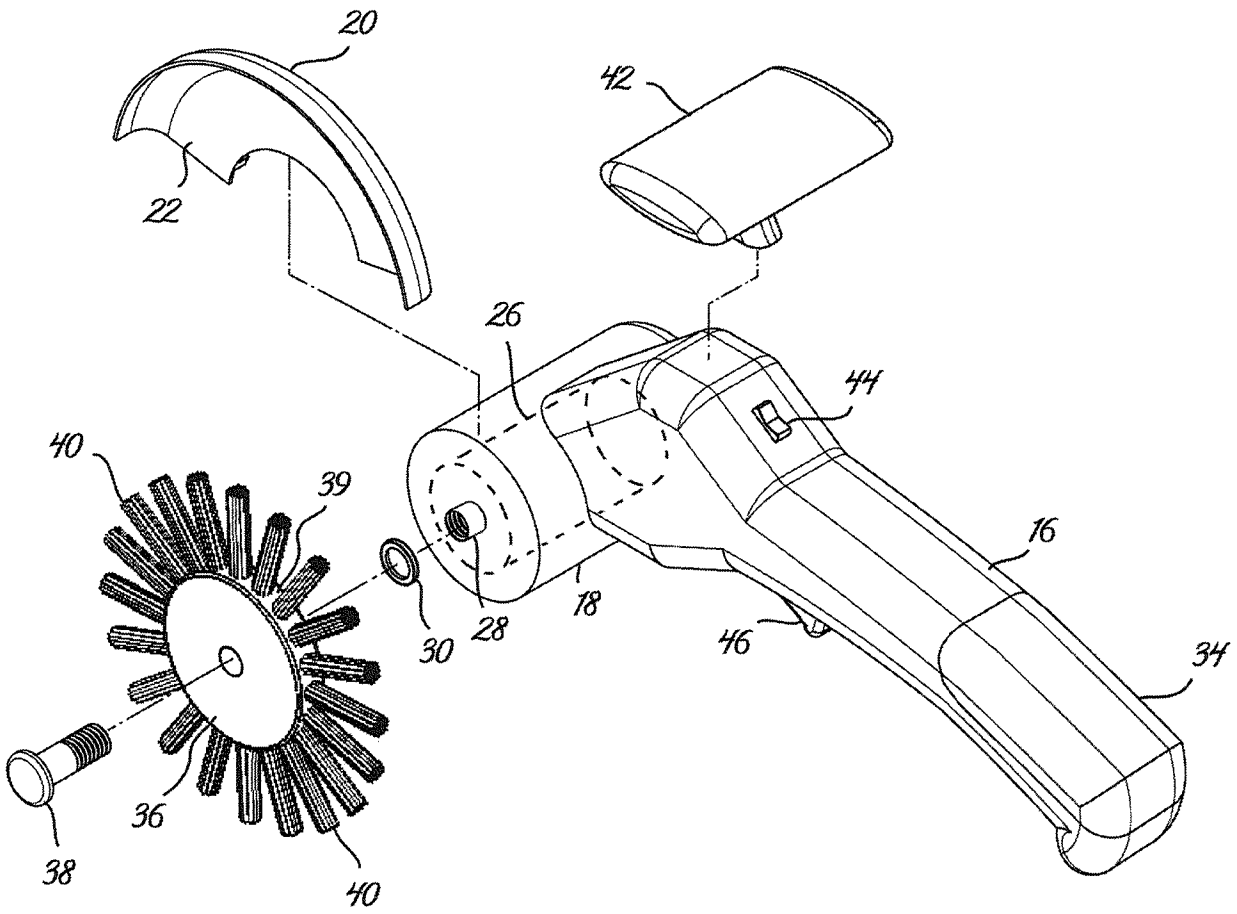
FIG. 4 is an exploded rear perspective illustration of the system of the prior Figures.

With reference now to the drawings, and in particular to FIG. 1 thereof, the preferred embodiment of the new and improved compact cleaning system embodying the principles and concepts of the present invention and generally designated by the reference numeral 10 will be described.

The present invention, the compact cleaning system 10, is comprised of a plurality of components. In their broadest context such include a housing, a handle, a motor, and a brush wheel. Such components are individually configured and correlated with respect to each other so as to attain the desired objective.

In the preferred embodiment of the compact cleaning system, designated by reference numeral 10, first provided is a hollow housing 14 formed of a left side, a right side, a rearward section, and a forward section. The hollow housing has a rearward end with a primary handle 16. The hollow housing has a forward end with a motor housing 18 and a laterally spaced guard housing 20. The guard housing is located to the left side of the motor housing. The hollow housing has a housing axis extending between the forward end and the rearward end. The guard housing has an open left side 22. The hollow housing and the guard housing are fabricated of a rigid plastic material.

Next provided is a motor 26 located within the motor housing. The motor has a drive shaft 28 rotatable around a horizontal axis of rotation which is perpendicular to the housing axis. The drive shaft is adapted to extend into the guard housing. The drive shaft has an O-ring 30 to prevent fluids from entering the motor housing. Provided next is a source of electrical power 32. The source of electrical power is within the rearward end and is operatively coupled to the motor. The primary handle has a cover 34 adapted to be removably coupled for accessing the source of electrical power. The source of electrical power is a battery or a rechargeable battery.

A brush wheel 36 fabricated of a rigid plastic material is next provided. The brush wheel is mounted on the drive shaft and secured with a bolt 38 for rotation. The brush wheel is mounted for rotation in a vertical plane. The brush wheel has a first diameter of between 1.75 inches and 2.25 inches. The brush wheel has an annular surface 39 with a width of 0.5 inches, plus or minus 20 percent. A plurality of bristle tufts 40 adapted to extend from the axial surface are provided. Each bristle tuft is comprised of a plurality of bristles. Each bristle within each bristle tuft has a diameter between 0.02 inches and 1.25 inches. Each bristle has a bristle length of between 0.75 inches and 1.25 inches. Each bristle is fabricated of a plastic material. Each bristle tuft has a tip. The tips are in a circle with an exterior diameter between 3.75 inches and 4.25 inches. The exterior diameter is between 2.14 to 1.88 times greater than the first diameter. Each bristle tuft of the brush wheel is adapted to deform and brush extraneous grout from tiles and pavers for cleaning purposes while the motor and the brush wheel are rotating. The brush wheel and bristles are removable and replaceable.

Finally, in the preferred embodiment, a control assembly is provided. The control assembly includes a switch 44 on the primary handle for being depressed by a user to activate the motor. The switch is configured with predetermined settings for making incremental adjustments to the motor rpm. The control assembly also includes a trigger 46 on the primary handle for being squeezed by the user to keep the motor active. The trigger is adapted to become inactive by the release of the trigger by the user.

In another embodiment, the handle is telescopic for ease of handling.

In operation and use, the vertical brush is narrow enough to get in tight places, such as grooves, where cleaning cloths and paper towels cannot reach. Rather than "push" the dirt into the grooves using a paper towel or cleaning cloth, the present invention lifts the dirt out and removes it, leaving behind a clean surface.

In an alternate embodiment of the invention a secondary handle 42 is provided. The secondary handle is adapted to be removably coupled to the hollow housing and gripped by the hand of a user for increased control during operation.

The present invention includes a cleaning method. Such method is comprised of a plurality of steps. The first step is providing a housing having an rearward end with a handle. The housing has a forward end with a motor housing and a laterally spaced guard housing with an open side. The housing has a housing axis extending between the forward end and the rearward end.

The next step is providing a motor located within the motor housing. The motor has a drive shaft rotatable around a horizontal axis of rotation perpendicular to the housing axis. The drive shaft extends into the guard brush housing and is sealed with an O-ring.

The next step is providing a wheel mounted on the drive shaft for concurrent rotation of the wheel and the drive shaft. The wheel is constructed with radially extending bristles.

The next step is rotating the wheel and the bristles about a horizontal axis of rotation coextensive with the axis of rotation of the drive shaft.

The final step is brushing and cleaning small bathroom grout, tub and shower walls and floors, kitchen and bathroom sinks, especially under-mounted, around windows and more.

The present invention includes vertical cleaning technology with the bristles rotating in a vertical plane about a horizontal axis.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A compact cleaning method consisting the steps of:

providing a grout cleaning device consisting of:

a hollow housing (14) formed of a left side, a right side, a rearward section and a forward section, the hollow housing having a rearward end with a primary handle (16) to be gripped by a user, the hollow housing having a forward end with a motor housing (18) and a laterally spaced guard housing (20), the guard housing being located to a left side of the motor housing, the hollow housing having a housing axis extending between the forward end and the rearward end, the guard housing having an open left side (22), the hollow housing and the guard housing being fabricated of rigid plastic;

a motor (26) located within the motor housing, the motor having a drive shaft (28) rotatable around a horizontal axis of rotation perpendicular to the housing axis, the drive shaft extending into the guard housing, the drive shaft having an O-ring (30) to prevent fluids from entering the motor housing;

a source of electrical power (32) located within the rearward end and connected to the motor, the primary handle having a cover (34) being removably coupled for accessing the source of electrical power;

a brush wheel (36) fabricated of rigid plastic material, the brush wheel being mounted on the drive shaft and secured with a bolt (38) for rotation, the brush wheel having a first diameter, the brush wheel consisting of a wheel having an annular surface (39) with a width of 0.5 inches, plus or minus 20 percent, a plurality of bristle tufts (40) extending from the annular surface in an annular plane, each bristle tuft including a plurality of bristles, each bristle within each tuft having a circular cross section and a circular tip with a diameter between of 0.02 inches and 0.03 inches, each bristle having a bristle length between 0.75 inches and 1.25 inches, each bristle tuft being fabricated of a plastic material, each bristle tuft having a tip, the tips being in a circle with an exterior diameter;

a secondary handle (42) being removably coupled to the hollow housing, the secondary handle adapted to be gripped by the user;

a control assembly including a switch (44) on the primary handle adapted to be depressed by the user to activate the motor, the switch further having settings to control a speed of the motor, the control assembly also including a trigger (46) on the primary handle adapted to be squeezed by the user to keep the motor active, the trigger adapted to be released by the user to inactive the motor;

activating the motor by the switch on the primary handle;

depressing the trigger to keep the motor active;

rotating the brush wheel and the bristles about an axis of rotation coextensive with the axis of rotation of the drive shaft;

brushing and cleaning grout and other surfaces, including tub and shower walls, kitchen and bathroom sinks including under-mounted sinks, and around windows; and releasing the trigger to inactivate the motor.

* * * * *